US006420911B1

(12) United States Patent
Warmerdam et al.

(10) Patent No.: US 6,420,911 B1
(45) Date of Patent: Jul. 16, 2002

(54) BALLAST CIRCUIT FOR OPERATING A LAMP

(75) Inventors: Leonardus F. P. Warmerdam; Hendrik Boezen, both of Nijmegen (NL)

(73) Assignee: Koninklijke Philips Electronics N.V. (NL)

( * ) Notice: Subject to any disclaimer, the term of this patent is extended or adjusted under 35 U.S.C. 154(b) by 846 days.

(21) Appl. No.: 08/705,569

(22) Filed: Aug. 29, 1996

(30) Foreign Application Priority Data

Aug. 29, 1995 (EP) ..... 95202331

(51) Int. Cl.[7] ..... G05F 3/26; G06G 7/10
(52) U.S. Cl. ..... 327/103; 323/316
(58) Field of Search ..... 327/103, 100, 327/77, 558, 311, 551; 315/307; 323/284, 315, 313, 316

(56) References Cited

U.S. PATENT DOCUMENTS 4,017,749 A * 4/1977 Seki et al. ..... 327/311
4,703,249 A 10/1987 De La Plaza et al. ..... 323/316
5,231,316 A * 7/1993 Thelen, Jr. ..... 327/103

OTHER PUBLICATIONS

The Diagram Group, Macmillan Visual Desk Reference 218 (1993).*

* cited by examiner

*Primary Examiner*—Dinh T. Le
(74) *Attorney, Agent, or Firm*—Dicran Halajian

(57) ABSTRACT

A ballast circuit for operating a lamp provided with a voltage-current converter, the ballast circuit having a differential amplifier provided with a first input terminal for connection to a reference voltage source for generating a reference voltage, a second input terminal for connection of a reference resistor, and an output. A first current generator supplies a first current to the reference resistor. A current amplifier generates a second current and is provided with an input coupled to the output of the differential amplifier. The differential amplifier is provided with a low-pass filter. The current amplifier on the one hand and the current generator and the reference resistor on the other hand exclusively comprise mutually separate components. The ballast circuit is in addition provided with a current control circuit coupled to the current amplifier and to the current generator for influencing the first current dependent upon the second current. As a result, an interference signal present at the second input terminal causes no appreciable interference in the second current.

12 Claims, 1 Drawing Sheet

BALLAST CIRCUIT FOR OPERATING A LAMP

BACKGROUND OF THE INVENTION

This invention relates to a circuit arrangement provided with a voltage-current converter, comprising a differential amplifier provided with a first input terminal for connection to a reference voltage source for generating a reference voltage Vref, a second input terminal for connection of a reference resistor Rref, and an output, means I for generating a first current through the reference resistor Rref, and a current amplifier for generating a second current and provided with an input coupled to the output of the differential amplifier.

Such a circuit arrangement forms part of the integrated circuit UBA2020. In the known circuit arrangement, the current amplifier is a source follower built up from a series arrangement of a transistor and the reference resistor, the output of the differential amplifier being connected to a control electrode of the transistor. The reference resistor thus forms part of the current amplifier, the means I are formed by the transistor and the supply voltage of the source follower. The transistor also forms part of the current amplifier, and the first and second currents are identical. During operation of the circuit arrangement, the output of the differential amplifier keeps the potential at the control electrode of the transistor at a level such that the signal present at the first input of the differential amplifier is substantially equal to the signal present at the second input of the differential amplifier. It is achieved thereby that the relation Vref=Rref*Iref is substantially complied with. Vref here is the reference voltage, Rref the resistance value of the reference resistor, and Iref the current flowing through the reference resistor. The current Iref in the known circuit arrangement is at the same time the current generated by the voltage-current converter. The reference resistor in the known circuit arrangement is not realized within the integrated circuit but is a discrete component which is connected to the second input terminal via a pin of the integrated circuit. The known integrated circuit is mostly used in an electronic lamp ballast comprising a bridge circuit and is designed for controlling this bridge circuit. The bridge circuit generates a high-frequency square-wave voltage whose amplitude is usually of the order of 100 V during lamp operation, and the point where this voltage is available is usually comparatively close to the integrated circuit. The printed conductor track, and the pin of the integrated circuit with which the connection between the reference resistor and the second input terminal is realized together form a parasitic capacitance. The high-frequency square-wave voltage generated by the bridge circuit causes a high-frequency interference signal via this parasitic capacitance, which signal is superimposed on the voltage across the reference resistor. Such a high-frequency interference signal also influences the voltage between the control electrode and the main electrode of the transistor to the reference resistor. As a result, a high-frequency interference signal of comparatively great amplitude is also present in the current generated by the current amplifier. The operation of the circuit arrangement is adversely affected thereby.

SUMMARY OF THE INVENTION

It is an object of the invention to provide a circuit arrangement comprising a voltage-current converter wherein the current generated by this voltage-current converter suffers from only a comparatively small amount of interference.

According to the invention, a circuit arrangement as described in the opening paragraph is for this purpose characterized in that the differential amplifier is provided with a low-pass filter, in that the current amplifier on the one hand and the means I and the reference resistor on the other hand exclusively comprise mutually separate components, and in that the circuit arrangement is in addition provided with means II coupled to the current amplifier and to the means I for influencing the first current in dependence on the second current.

According to the invention, the current amplifier on the one hand and the means I and the reference resistor on the other hand exclusively comprise mutually separate components, i.e. the current amplifier on the one hand, and the means I and the reference resistor on the other hand do not have any components in common.

When the circuit arrangement is in operation, the signal present at the output of the differential amplifier is maintained at a level such that the signals present at the first and second input terminals of the amplifier are substantially equal. It is achieved thereby that the relation Vref=Iref*Rref is substantially complied with, so that the amplitude of the first current is substantially equal to Vref/Rref. The signal present at the output of the differential amplifier is also present at the input of the current amplifier and determines the amplitude of the second current generated by this current amplifier. The amplitude of the first current (Iref) is influenced by the means II in dependence on the amplitude of the second current. The second current thus has an amplitude which is determined by the amplitude of the first current and by the means II during stationary operation of the circuit arrangement. The second current is the current generated by the voltage-current converter. If a high-frequency interference signal is present and superimposed on the voltage across the reference resistor during operation of the circuit arrangement, this interference signal will not be present in the current amplifier as well, because the reference resistor does not form a part of the current amplifier. Since the differential amplifier is provided with a low-pass filter, said high-frequency interference signal present at the second input terminal only gives rise to a further high-frequency interference signal of comparatively small amplitude which is superimposed on the signal at the output of the differential amplifier. As a result, little interference is also present at the input of the current amplifier and in the current generated by the current amplifier. Owing to this reduced amount of interference in the current generated by the voltage-current converter, a detrimental effect on the operation of the circuit arrangement owing to interference occurs to a comparatively low degree only.

The low-pass filter may comprise, for example, an ohmic resistor and a capacitance.

In an advantageous embodiment of a circuit arrangement according to the invention, the means II comprise a current mirror for generating a current whose amplitude is substantially equal to the amplitude of the second current, and the means I are formed by a coupling between an output of the current mirror and the reference resistor. In this advantageous embodiment, the first current is derived from the second current by the current mirror, and the first and second currents substantially have the same amplitude. Since current mirrors are widely used in integrated circuits for generating from a given current a number of further currents with substantially the same amplitude, this advantageous embodiment is especially suitable for implementation in an integrated circuit.

Favorable results were obtained with circuit arrangements according to the invention wherein the current amplifier is a source follower. The source follower is a comparatively simple and inexpensive type of current amplifier.

It was found that a further suppression of the interference can be achieved when the reference resistor is shunted by capacitive means. The capacitive means here serve as a filter for the high-frequency interference signal.

It was also found that the circuit arrangement is highly suitable for being constructed at least in part as an integrated circuit.

BRIEF DESCRIPTION OF THE DRAWINGS

Embodiments of the invention will be explained with reference to the accompanying drawing, in which.

DESCRIPTION OF THE PREFERRED EMBODIMENTS

Figure 1:
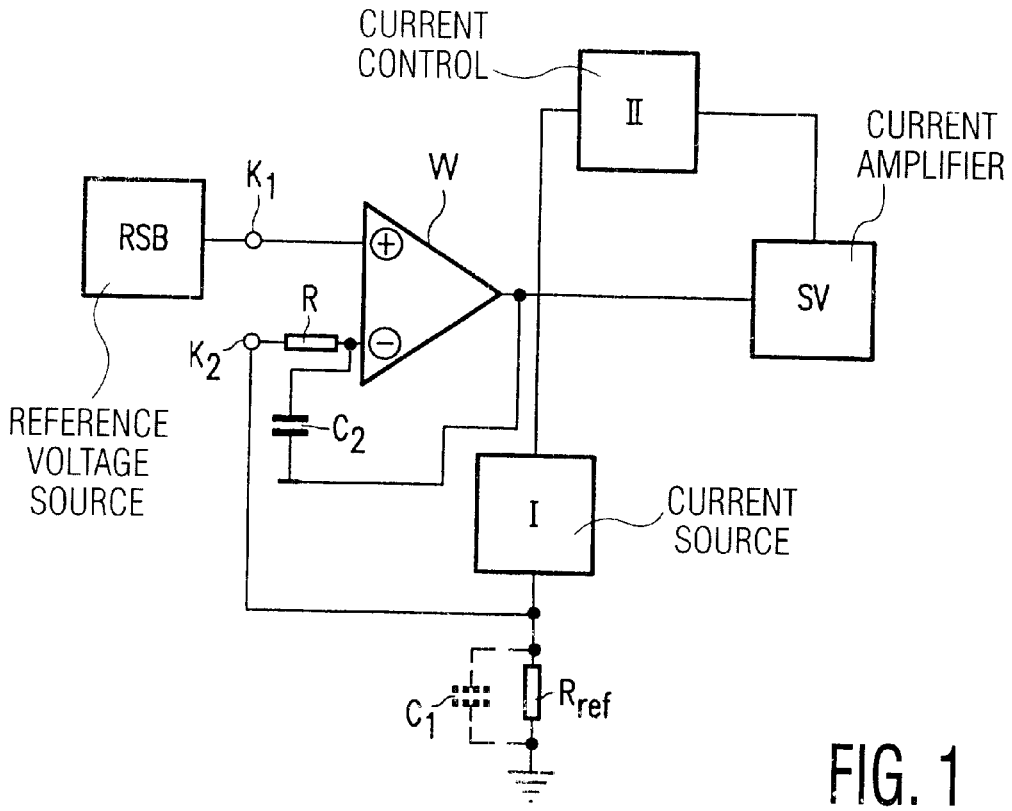
FIG. 1 is a diagram of a first embodiment of a circuit arrangement according to the invention.

In FIG. 1, a ballast circuit includes a control circuit CC for operating a discharge lamp LA via a bridge circuit BC. The control circuit comprises a differential amplifier W provided with a low-pass filter formed by ohmic resistor R and capacitor C2. Differential amplifier W is also provided with a first input terminal K1 for connection to a reference voltage source RSB. The first input terminal is connected to a first input of differential amplifier W. RSB is a reference voltage source for generating a reference voltage Vref. An output of RSB is connected to first input terminal K1. K2 is a second input terminal of differential amplifier W for connection to a reference resistor. Input terminal K2 is connected to a first end of ohmic resistor R. A further end of ohmic resistor R is connected to both a first side of capacitor C2 and a second input of differential amplifiers W. A further side of capacitor C2 is connected to an output terminal of differential amplifier W. Rref is a reference resistor whose first end is connected to second input terminal K2 and whose further end is connected to ground. The first end of reference resistor Rref is also connected to an output of circuit portion I which in this embodiment forms means I for generating a first current through the reference resistor Rref. Rref may be shunted by a capacitors C1. The output terminal of differential amplifier W is connected to an input of current amplifier SV for generating a second current. An output of current amplifier SV is connected to an input of circuit portion II which in this embodiment forms means II for influencing the first current in dependence on the second current. An output of circuit portion II is for this purpose connected to an input of circuit portion I.

The operation of the embodiment shown in FIG. 1 is as follows.

When the circuit arrangement is in operation, the signal present at the output of differential amplifier W is kept at a level such that the signals present at the first input and the second input of the amplifier are substantially equal to one another. It is achieved thereby that the relation Vref=Iref*Rref is substantially complied with, so that the amplitude of the first current Iref is substantially equal to Vref/Rref. The signal present at the output of differential amplifier W is also present at the input of current amplifier SV and determines the amplitude of the second current generated by the current amplifier. The amplitude of the first current (Iref) is influenced by circuit portion II via circuit portion I in dependence on the amplitude of the second current. The second current thus has an amplitude determined by the amplitude of the first current and by circuit portion II during stationary operation of the circuit arrangement. Said second current is the current generated by the voltage-current converter. If a high-frequency interference signal is present during operation of the circuit arrangement and superimposed on the voltage across the reference resistor Rref, this interference signal is not also present in the current amplifier SV because the reference resistor Rref does not form part of the current amplifier SV. Since the differential amplifier W is provided with a low-pass filter, this high-frequency interference signal present at the second input terminal K2 gives rise to a further high-frequency interference signal of an only comparatively small amplitude superimposed on the signal at the output of the differential amplifier W. As a result, little interference is also present at the input of the current amplifier SV and in the second current generated by the current amplifier SV and in the first current influenced by circuit portion II in dependence on this second current. Owing to this smaller amount of interference in the current generated by the voltage-current converter, the operation of the circuit arrangement is adversely affected by interference to a comparatively low degree only.

Figure 2:
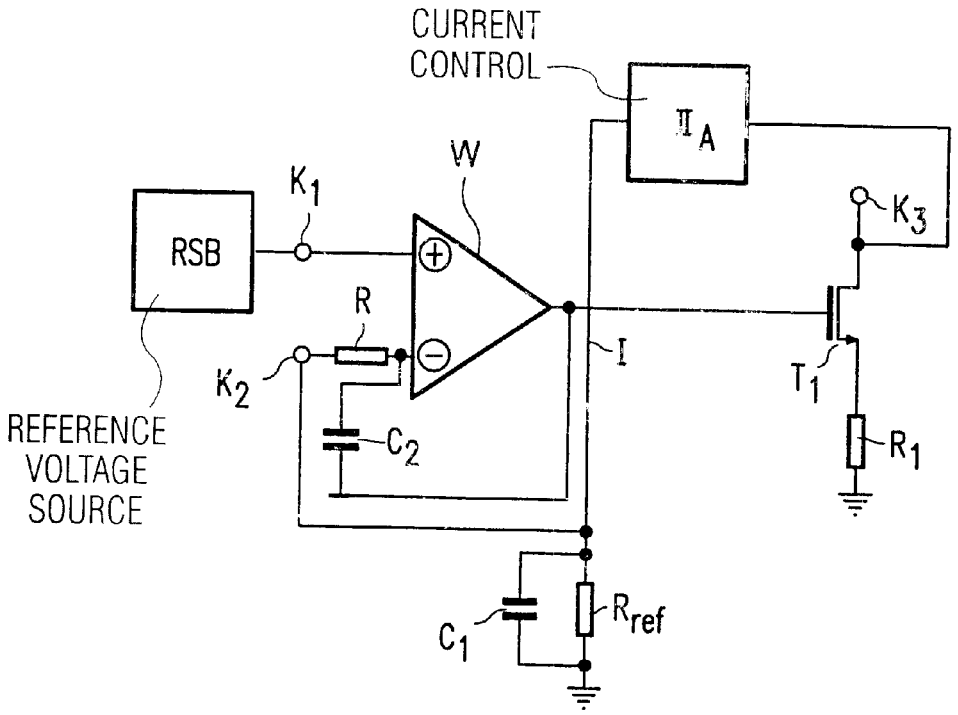
FIG. 2 is a diagram of a second embodiment of a circuit arrangement according to the invention.

In FIG. 2, circuit portions and components corresponding to circuit portions and components forming part of the embodiment shown in FIG. 1 have been given the same reference symbols. The reference resistor Rref in this embodiment is shunted by capacitive means formed by capacitor C1. The current amplifier in this embodiment is constructed as a source follower comprising field effect transistor T1 and ohmic resistor R1. K3 is a terminal at which a DC voltage is present during operation of the circuit, generated by means not shown in FIG. 2. Circuit portion IIa in this embodiment is a current mirror for generating a current whose amplitude is substantially equal to the amplitude of the second current. Means I for generating a first current through the reference resistor are formed by a coupling consisting of a conductive connection I between an output of circuit portion IIa and reference resistor Rref in this embodiment. The portion of this embodiment which differs from or is more detailed than the embodiment shown in FIG. 1 is constructed as follows. The output of differential amplifier W is connected to a control electrode of field effect transistor T1. A first main electrode of field effect transistor T1 is connected to terminal K3 and also to an input of current mirror IIa. A second main electrode of field effect transistor T1 is connected to a first end of ohmic resistor R1. A second end of ohmic resistor R1 is connected to ground. An output of current mirror IIa is connected to the first end of reference resistor Rref via conductive connection I. The remaining portion of the embodiment shown in FIG. 2 is constructed as the embodiment shown in FIG. 1.

The operation of the embodiment shown in FIG. 2 is as follows.

When the circuit arrangement is in operation, the signal present at the output of differential amplifier W is kept at a level such that the signals present at the first input and the second input of the amplifier are substantially equal, as is the case in the embodiment shown in FIG. 1. It is achieved thereby that the relation Vref=Iref*Rref is substantially complied with, so that the amplitude of the first current Iref is substantially equal to Vref/Rref. The signal present at the output of differential amplifier W is also present at the control electrode of field effect transistor T1 and controls the amplitude of the second current flowing through field effect transistor T1 and ohmic resistor R1. Current mirror IIa generates a current whose amplitude is substantially equal to that of the second current. The current generated by current mirror IIa is supplied to reference resistor Rref via conductive connection I. A first current whose amplitude is substantially equal to that of the second current thus flows through Rref during stationary operation of the circuit arrangement.

If a high-frequency interference signal is present and superimposed on the voltage across the reference resistor Rref during operation of the circuit arrangement, this high-frequency interference signal is not only suppressed by the low-pass filter of differential amplifier W but also by capacitor C1 which shunts the reference resistor Rref. The high-frequency interference signal present at the second input terminal K2 as a result gives rise to a further high-frequency interference signal of an only comparatively low amplitude superimposed on the signal at the output of differential amplifier W. As a result, little interference is present also at the control electrode of field effect transistor T1 and in the second current flowing through field effect transistor T1 and ohmic resistor R1, and in the first current generated by current mirror IIa. Owing to this reduced amount of interference in the current generated by the voltage-current converter, the operation of the circuit arrangement is adversely affected by interference to a comparatively low degree only.

What is claimed is:

1. A ballast circuit arrangement for operating a discharge lamp wherein a high-frequency interference signal appears across a reference resistor, the ballast circuit comprising: a bridge circuit supplying a high frequency voltage to the discharge lamp, and a control circuit for controlling the bridge circuit, said control circuit including a voltage-current converter, comprising a differential amplifier provided with a first input terminal for connection to a reference voltage source for generating a reference voltage, a second input terminal coupled to the reference resistor, and an output, first means for generating a first current through the reference resistor, and a current amplifier for generating a second current and having an input coupled to the output of the differential amplifier, wherein the differential amplifier includes a low-pass filter independent of the reference resistor and connected to the second input terminal of said differential amplifier, in that the first means and the reference resistor comprise mutually separate components from components of the current amplifier, and the ballast circuit arrangement further comprises a second means coupled to the current amplifier and to the first means for controlling the first current dependent upon the second current, whereby the voltage-current converter significantly reduces the high-frequency interference signal across the reference resistor.

2. A ballast circuit arrangement as claimed in claim 1, wherein the low-pass filter comprises an ohmic resistor and a capacitance.

3. A ballast circuit arrangement as claimed in claim 2, wherein the second means comprise a current mirror for generating a current whose amplitude is substantially equal to the amplitude of the second current, and the first means comprise a coupling between an output of the current mirror and the reference resistor.

4. A ballast circuit arrangement as claimed in claim 3, wherein the current amplifier is a source follower.

5. A ballast circuit arrangement as claimed in claim 4, wherein the reference resistor is shunted by capacitive means.

6. A ballast circuit arrangement as claimed in claim 5, wherein the circuit arrangement is at least partly constructed as an integrated circuit.

7. A ballast circuit arrangement as claimed in claim 1, wherein the means II comprise a current mirror for generating a current whose amplitude is substantially equal to the amplitude of the second current, and the means I comprise a coupling between an output of the current mirror and the reference resistor.

8. A ballast circuit arrangement as claimed in claim 1, wherein the current amplifier is a source follower.

9. A ballast circuit arrangement as claimed in claim 1, wherein the reference resistor is shunted by capacitive means.

10. A ballast circuit arrangement as claimed in claim 1, wherein the circuit arrangement is at least partly constructed as an integrated circuit.

11. A ballast circuit arrangement as claimed in claim 3, wherein the reference resistor is shunted by capacitive means.

12. A ballast circuit as claimed in claim 1 wherein said low-pass filter is independent of the reference resistor and comprises a resistor connected between the reference resistor and the second input terminal of the differential amplifier and a capacitor connected between said second input terminal and the output of the differential amplifier.

* * * * *